United States Patent [19]

Tilman

[11] Patent Number: 5,024,537

[45] Date of Patent: Jun. 18, 1991

[54] TAPE CARRIED PRE-CUT ZIPPER

[75] Inventor: Paul A. Tilman, New York, N.Y.

[73] Assignee: Zip-Pak Incorporated, Northbrook, Ill.

[21] Appl. No.: 461,651

[22] Filed: Jan. 8, 1990

[51] Int. Cl.[5] ..... B65D 33/16; B65D 33/34

[52] U.S. Cl. ..... 383/63; 383/5; 383/61; 206/820; 24/400; 24/403

[58] Field of Search ..... 24/396, 397, 398, 399, 24/400, 403; 383/5, 61, 63, 64; 206/343, 449, 526, 820

[56] References Cited

U.S. PATENT DOCUMENTS

| | | | |
|---|---|---|---|
| 2,555,983 | 6/1951 | Mathiesen | 206/820 X |
| 2,978,769 | 4/1961 | Harrah | 156/66 X |
| 2,994,469 | 8/1961 | Troup et al. | 383/61 X |
| 3,859,150 | 1/1975 | Van Amburg | 156/66 |
| 3,991,801 | 11/1976 | Ausnit | 383/61 |
| 4,691,373 | 9/1987 | Ausnit | 383/63 |
| 4,756,629 | 7/1988 | Tilman et al. | 383/63 |
| 4,892,414 | 1/1990 | Ausnit | 383/63 |
| 4,896,775 | 1/1990 | Boeckmann et al. | 385/63 X |
| 4,925,318 | 5/1990 | Sorensen | 383/63 |

FOREIGN PATENT DOCUMENTS

| | | | |
|---|---|---|---|
| 302144 | 2/1989 | European Pat. Off. | 383/5 |

*Primary Examiner*—Stephen Marcus
*Assistant Examiner*—Jes F. Pascua
*Attorney, Agent, or Firm*—Hill, Van Santen, Steadman & Simpson

[57] ABSTRACT

Straight zipper sections are attached to a carrier tape for attachment to the mouth end of a bag. The straight zipper sections are mounted on the continuous tape in longitudinal series orientation, or in spaced side-by-side orientation across the length of the tape. The tape in either case may be fan folded and packed into a storage or shipping container. The tape provides for closing attachment across the mouth of a bag to provide a security membrane and/or a tamper evident structure required to be ruptured to gain initial access into the bag after the zipper is opened.

19 Claims, 2 Drawing Sheets

TAPE CARRIED PRE-CUT ZIPPER

BACKGROUND OF THE INVENTION

The present invention relates in general to the bag making art, and is more particularly concerned with a new and improved method of and means for providing extruded thermoplastic reclosable fastener means, commonly referred to as zipper, for bags which may be formed from plastic film and provided with mouth ends closable by means of the zipper.

As heretofore generally provided, the zippers have either been extruded integrally with the bag making film, or the zippers may have been preformed in continuous strip and supplied in rolls for subsequent use in a bag making line. This is exemplified in recently issued U.S. Pat. No. 4,835,835.

An inherent disadvantage of the continuous rolling of thermoplastic zipper is the distortion that develops due to the memory of the winding system. This manifests itself as memory of the spool known as curvature and camber which causes deviation from a straight line. It may be noted, however, that in the accepted mode of applying zipper to substrates in packaging machines, the zipper is kept under tension in order to minimize the difficulty in application of the zipper to the substrate. In cases where zero deviation from straightness is required, the zipper must be held under extreme tension. In applications where the zipper cannot be held under tension, application of the zipper to a substrate is virtually unattainable.

The provision of sectional lengths of zipper to be applied to the outside of bags is disclosed in U.S. Pat. No. 4,691,373. In that disclosure, pressure sensitive adhesive is provided on the predetermined length of zipper and a peelable protective strip is applied over the pressure sensitive adhesive until the sectional length of zipper is to be used. That disclosure does not meet the problem of supplying predetermined lengths of zipper in a ready availability mode for applying separate lengths of the zipper to bags in a bag production line, especially as conducted in a bag making machine.

SUMMARY OF THE PRESENT INVENTION

The present invention provides a new and improved method and means for solving the problems discussed hereinabove.

An important object of the present invention is to provide a continuous line supply of reclosable zipper capable of being applied without exhibiting curvature or camber.

Another object of the present invention is to provide a reclosable zipper with a membrane or web material as a component of its construction.

A further object of the present invention is to provide a reclosable zipper capable of being supplied in such a form that either in machine direction running or head running of the bag making film, application of the zipper sections to the bag making film can be effected substantially without reducing the line speed of the packaging machine.

Yet another object of the present invention is to provide a new and improved reclosable zipper with sealing compatibility to substrate by use of sealing compatibility of a carrier tape.

BRIEF DESCRIPTION OF THE DRAWINGS

Other objects, features and advantages of the present invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1A:
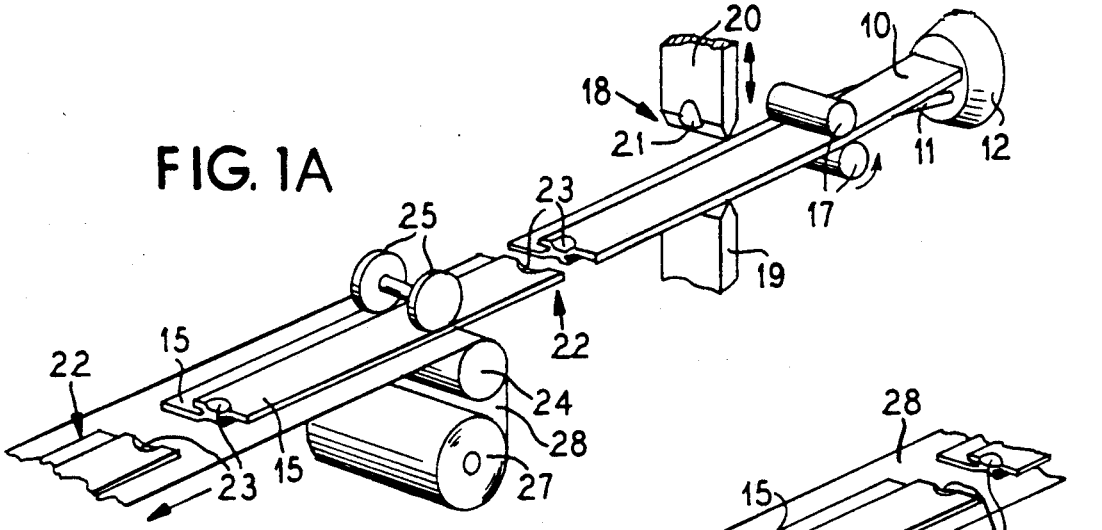
FIG. 1A is a more or less schematic perspective view demonstrating a method of producing sectional or predetermined length reclosable zipper according to one preferred embodiment of the invention.
Figure 1B:
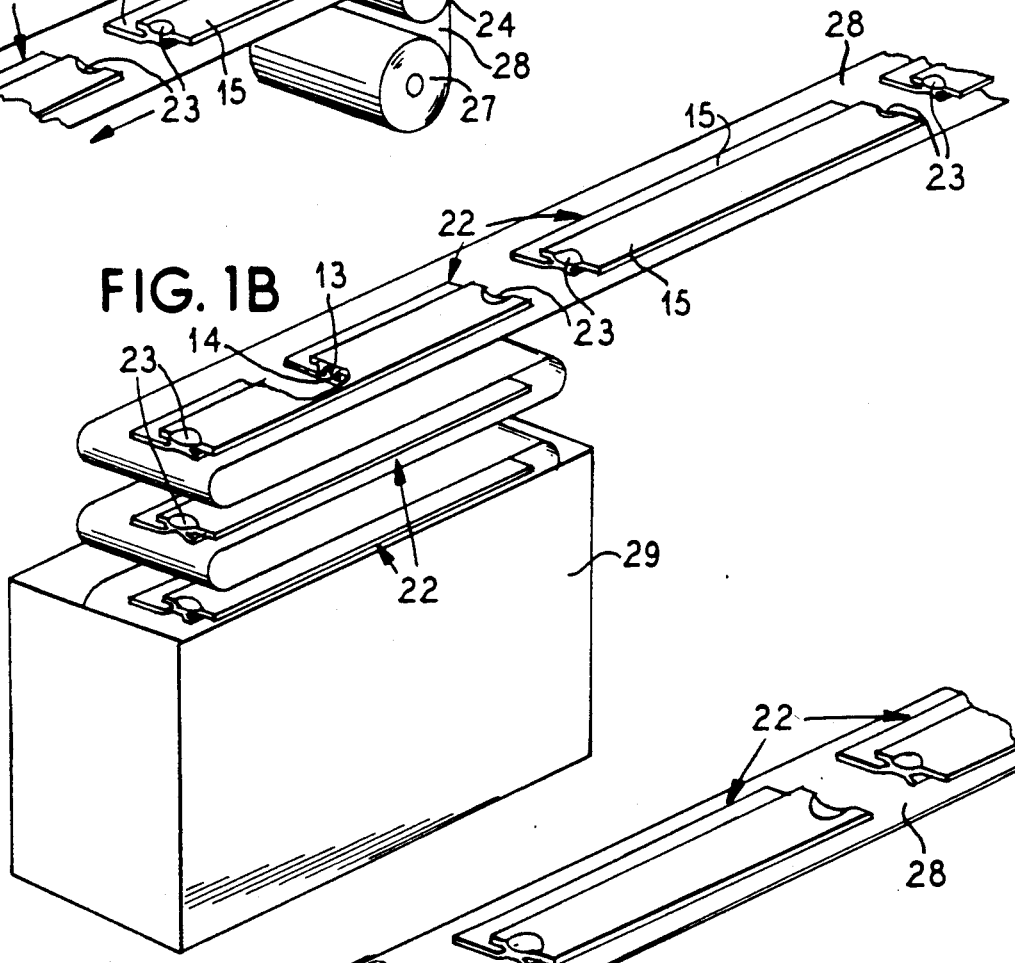
FIG. 1B is an extension of FIG. 1A and illustrates how the straight sectional zipper product is advantageously packed for further use.

Referring to FIGS. 1A and 1B, complementary reclosable zipper strips 10 and 11 are extruded from a desirable plastic material by extrusion means including extruder apparatus 12 disclosed schematically. It will be understood that, as is usual, the extruder apparatus will also include appropriate chilling means so that promptly after issuing of the zipper strips from the extruder nozzle, they will be satisfactorily set to retain the desired cross section, including generally hooked shape zipper profiles 13 on the strip 10 which cooperate reclosably with complementary zipper profiles 14 on the strip 11. As shown, the profiles 13 and 14 are disposed along respective margins of the strips 10 and 11 and from which margins the strips extend in respectively opposite directions to provide respective base flanges 15 on and along the strips. As soon as the strips 10 and 11 are self-sustaining after the extrusion process, they are joined together by releasably interlocking the profiles 13 and 14 by passing the cooperating strips between driving pinch rolls 17, rotatively complementally driven in any well know manner. From the pinch rolls 17, the zipper assembly travels rectilinearly through cutoff and spot sealing means 18, schematically illustrated as of generally the guillotine type including an underlying anvil member 19 and a reciprocating cutoff member 20. Combined with or associated with the members 19 and 20 is spot sealing means 21 by which the profile areas of the zipper assembly at the ends of zipper section lengths 22 are provided with spot seals 23 which flatten the profile areas to nearer the thickness of the flanges 15 to facilitate subsequent sealing of the ends of the strips into side seals of bags with which the sections are incorporated.

As the continuous zipper strip assembly is fed forwardly by the feed pinch rolls 17, the sectional lengths 22 of the zipper assembly are advanced, before being cut off, to and between feed rolls 24 and 25. At this point there is advanced from a suitable supply, such as a roll 27 or other suitable supply, a continuous carrier tape 28 somewhat wider than the overall width of the zipper sections 22 and trained over the feed roll 24 into engagement with the underfaces of the successive zipper sections 22. The relationship is such that with the zipper sections 22 centered along the length of the tape 28, the tape projects substantially uniformly, in this instance, to each side of the zipper strips.

At the feed rolls 24, 25, the flanges 15 of the discontinuous lengths of zipper sections 22 are desirably attached onto the carrier tape 28 travelling at a predetermined rate to insure accurate positioning of the zipper lengths thereon. While attachment of the flanges 15 to the carrier tape 28 may be effected in various ways known in the art, the feed roll 25 may be provided in the form of spaced parallel sections which press the flanges 15 against the tape 28 and simultaneously effect welding 25*a* (FIG. 3) of the flanges 15 to the tape. For this purpose, the flanges 15 and the tape are desirably formed from sealingly compatible thermoplastic material.

As the carrier tape 28 travels downstream with the attached uniformly relatively closely spaced zipper sections 22 thereon, it is, as shown in FIG. 1B longitudinally fan folded and received in a storage or shipping container, such as a carton 29.

Figure 2:
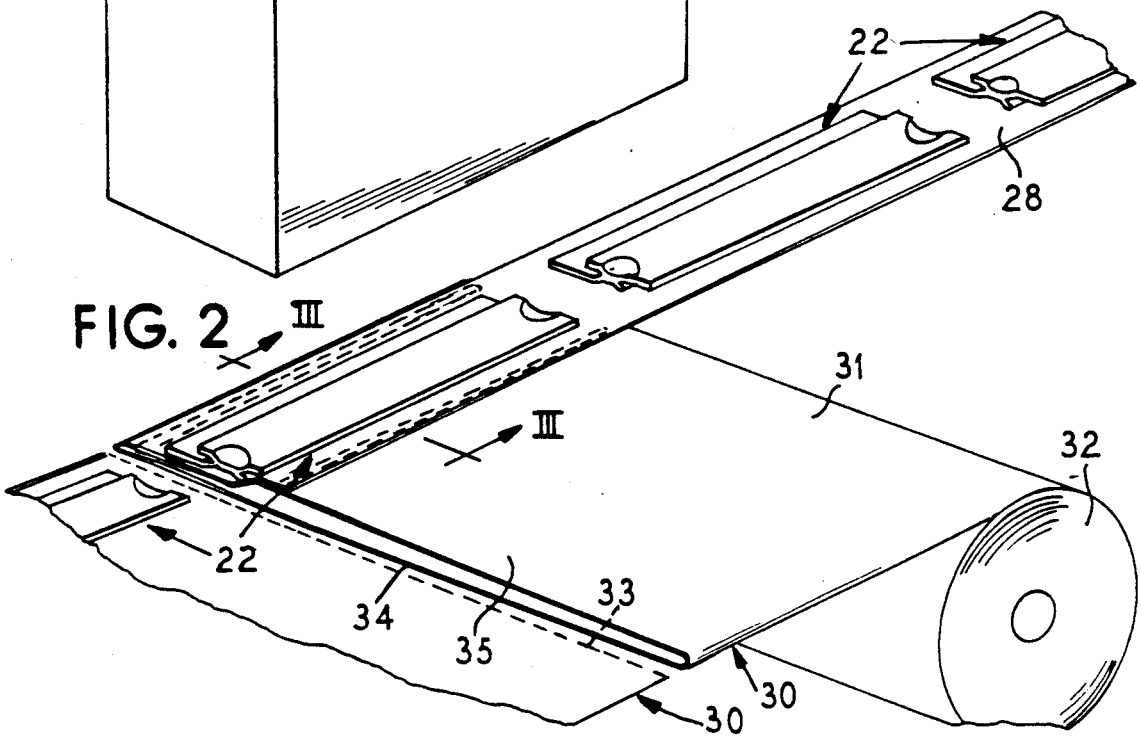
FIG. 2 is a more or less schematic illustration showing how the straight sectional zipper product of FIGS. 1A and 1B is adapted to be used in producing zipper equipped bags.

If desired, of course, the carrier tape 28 and supported succession of zipper section lengths 22 thereon may be utilized directly, and without packaging, on a bag making production line, such as depicted in FIG. 2. Of course, if the bag making line is located apart from the zipper production facility, then the packaged carrier tape and zipper assembly arrangement of FIG. 1B may serve as the zipper source. In any event, the zipper sections 22 as carried by the tape 28 are adapted to be continuously applied to the mouth end of bag sections 30 of bag making film material 31 which may be fed from a supply roll 32. As each zipper section 22 registers with a bag section 30, the leading bag section carrying thereon one of the zipper section 22 and the length of carrier tape 28 associated therewith, may be cut off from the next succeeding bag section 30 along a median cutoff line 33 between the spaced ends of the zipper sections 22 on the respective bag sections.

Figure 3:
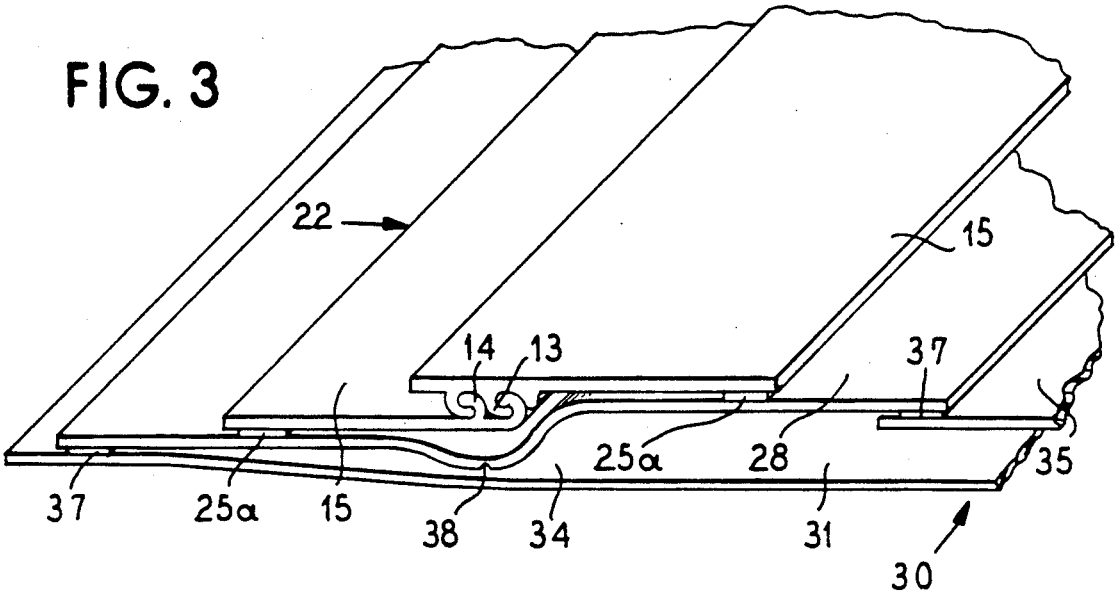
FIG. 3 is an enlarged fragmentary sectional detail view taken substantially along the line III—III in FIG. 2.

As shown in FIGS. 2 and 3, the bag sections 30 may be in what may be termed a J-fold wherein the bag mouth end of one wall 34 of the bag projects sufficiently beyond the bag mouth end of the opposed bag wall 35 so that the width of the tape 28 will substantially bridge between the opposite margins of the mouth ends of the bag walls 34 and 35. Attachment of the tape 28 to the bag walls may be along respective seals 37. For this purpose, the carrier tape 28 may be constructed from any preferred materials which are sealably compatible with the substrate bag film for effective bonding. If preferred, the carrier tape may comprise one or more materials designed to enhance the sealing of the tape onto the substrate. Through this arrangement, the tape may serve as a vapor retaining security membrane across the mouth of the bag and may also serve as a tamper evident device since in order to gain access into the filled and closed bag, the tape membrane must be fractured.

To facilitate deliberate fracturing of the tape membrane, a line of weakening 38 may be formed along the tape behind the zipper profiles 13, 14. Thereby not only must the zipper be opened for initial access into the bag, but the tape membrane 28 must also be opened, as by rupturing the same in order to gain such access.

Figure 4:
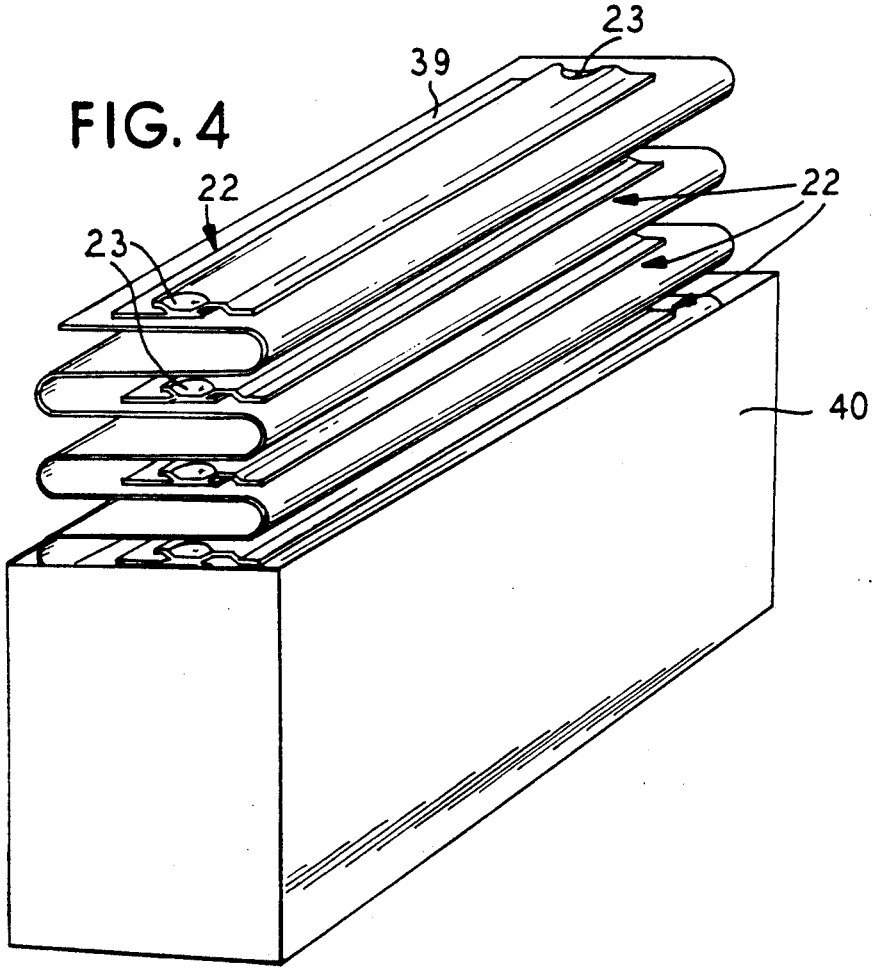
FIG. 4 is a more or less schematic perspective view showing an alternate manner of packing the straight sectional zipper sections.

While the longitudinal folding of the carrier tape as depicted in FIG. 1B is suitable for equipping bags where the zipper assembly is applied along the travelling axis of the bag material, where it is desired to apply the zipper sections 22 across the travelling axis of the bag material, the arrangement shown in FIG. 4 is adaptable for such purpose. Accordingly, the straight zipper sections 22 are secured across the longitudinal axis of the carrier tape 39 which may then be fan folded between the edges of the contiguous zipper strips, substantially as shown, and received in a storage/shipping container 40, unless the carrier and zipper section assembly is to be immediately used on a bag making line.

From the foregoing, it will apparent that the new and improved straight zipper section and carrying tape combination of the present invention is thoroughly compatible with productivity of bag making or packaging lines and is not detrimentally affected by the heretofore generally accepted difficulties of sealing similar materials of uneven thickness to incompatible substrates. Furthermore, there is no need for placing the straight zipper sections under tension for applying the same to the packages or bags since the zipper sections are free from curvature or camber. Also, the carrier tape serves as an advantageous membrane material in association with the zipper sections. The zipper section and carrier tape arrangement is adaptable to either machine or head-to-head applications without reducing the line speed of the packaging machine. By use of sealingly compatible carrier tape, the reclosable zipper is advantageously sealing compatible with respect to the bag material substrate.

It will be understood that variations and modifications may be effected without departing from the spirit and scope of the novel concepts of the present invention.

I claim as my invention:

1. A reclosable zipper assembly, comprising:

straight substantially coextensive extruded plastic zipper strips having complementary releasably interlockable profiles and providing a straight zipper section;

a carrier tape;

means permanently securing said zipper section to said carrier tape;

said carrier tape being continuous and carrying a plurality of said zipper sections; and said plurality of zipper sections extending in longitudinally adjacently spaced relation series on said tape.

2. A zipper assembly according to claim 1, wherein at least one edge portion of said tape extends laterally beyond the zipper sections and for securing the zipper assembly to the mouth end portion of bags.

3. A zipper assembly according to claim 1, wherein opposite edge portions of said tape extend laterally beyond side edges of the zipper sections for attachment to the mouth end of bags.

4. A zipper assembly according to claim 1, wherein opposite ends of said zipper sections are spot sealed at the profiles.

5. A reclosable zipper assembly, comprising:

straight substantially coextensive extruded plastic zipper strips having complementary releasably interlockable profiles and providing a straight zipper section;

a carrier tape;

means permanently securing said zipper section to said carrier tape;

said carrier tape being continuous and carrying a plurality of said zipper sections; and said zipper sections being located in spaced parallel relation across the length of said tape.

6. A reclosable zipper assembly, comprising:

straight substantially coextensive extruded plastic zipper strips having complementary releasably interlockable profiles and providing a straight zipper section;

a carrier tape;

means permanently securing said zipper section to said carrier tape;

said tape being fan folded between said sections; and a storage container into which the fan folded tape with the sections is loaded.

7. A reclosable zipper assembly, comprising:

straight substantially coextensive extruded plastic zipper strips having complementary releasably interlockable profiles and providing a straight zipper section;

a separately formed carrier tape;

means permanently securing said zipper section to said carrier tape, so that the assembly can be readily transported to a site for attachment of the assembly to a substrate by affixing the carrier tape to the substrate;

said carrier tape being continuous and carrying a plurality of said zipper sections; and said plurality of zipper sections extending in longitudinally aligned adjacently separated relation series on said tape.

8. An assembly according to claim 7, wherein at least one edge portion of said tape extends laterally beyond the zipper sections for securing the zipper sections to the mouth end portion of bags.

9. A zipper assembly according to claim 7, wherein opposite edge portions of said tape extend laterally beyond said edges of the zipper sections for attachment to the mouth end of bags.

10. A zipper assembly according to claim 7, wherein opposite ends of said zipper sections are spot sealed at the profiles.

11. A reclosable zipper assembly, comprising:

straight substantially coextensive extruded plastic zipper strips having complementary releasably interlockable profiles and providing a straight zipper section;

a separately formed carrier tape;

means permanently securing said zipper section to said carrier tape, so that the assembly can be readily transported to a site for attachment of the assembly to a substrate by affixing the carrier tape to the substrate;

said carrier tape being continuous and carrying a plurality of said zipper sections; and said zipper sections being located in separated parallel relation across the length of said tape.

12. An assembly according to claim 11, wherein at least one edge portion of said tape extends laterally beyond the zipper sections for securing the zipper sections to the mouth end portion of bags.

13. A zipper assembly according to claim 11, wherein opposite ends of said zipper sections are spot sealed at the profiles.

14. A reclosable zipper assembly, comprising:

straight substantially coextensive extruded plastic zipper strips having complementary releasably interlockable profiles and providing a plurality of straight zipper sections;

a separately formed carrier tape;

means permanently securing said zipper section to said carrier tape, so that the assembly can be readily transported to a site for attachment of the assembly to a substrate by affixing the carrier tape to the substrate;

said tape being fan folded between said sections; and a storage container into which the fan folded tape with the sections is loaded.

15. An assembly according to claim 14, wherein at least one edge portion of said tape extends laterally beyond the zipper sections for securing the zipper sections to the mouth end portion of bags.

16. A zipper assembly according to claim 14, wherein opposite edge portions of said tape extend laterally beyond side edges of the zipper sections for attachment to the mouth end of bags.

17. A zipper assembly according to claim 14, wherein opposite ends of said zipper sections are spot sealed at the profiles.

18. A bag and reclosable zipper assembly, comprising:

a bag having opposite walls in a generally J-fold orientation with edges in offset relation and defining a mouth;

a carrier tape having opposite longitudinal edge portions, and means securing said opposite edge portions to respectively said offset wall edges;

straight substantially coextensive first and second extruded plastic zipper strips, each of which has a base flange of substantial width and with a respective zipper profile along one edge of the base flange complementary to the zipper profile of the other of said zipper strips;

said base flange of said first zipper strip extending in one lateral direction from its profile;

said base flange of said second zipper strip extending in opposite lateral direction from its profile and relative to said base flange of said first zipper strip;

said zipper profiles facing toward one another and being releasably interlocked;

said oppositely extending base flanges lying in a substantially parallel relation on said carrier tape;

means securing edges of said base flanges remote from said zipper profiles permanently to said carrier tape adjacent to said means securing said opposite edge portions of the carrier tape to said offset bag wall edges in such a manner that the assembly lies substantially flat; and said carrier tape providing a rupturable sealing membrane in the span thereof between said zipper strip base sealing means.

19. An assembly according to claim 18, wherein said membrane has a line of weakening to facilitate rupturing thereof when said zipper strip profiles are separated and the sealing membrane is pulled apart at the separation.

* * * * *